US006296420B1

(12) United States Patent
Garbiso

(10) Patent No.: US 6,296,420 B1
(45) Date of Patent: Oct. 2, 2001

(54) FLUID CONTROL BAG ASSEMBLIES AND METHOD OF USING THE SAME

(76) Inventor: Michael J. Garbiso, 15058 Sierra Bonita La., Chino, CA (US) 91710

( * ) Notice: Subject to any disclaimer, the term of this patent is extended or adjusted under 35 U.S.C. 154(b) by 0 days.

(21) Appl. No.: 09/370,236

(22) Filed: Aug. 9, 1999

(51) Int. Cl.[7] ..... E02B 7/14
(52) U.S. Cl. ..... 405/111; 383/69
(58) Field of Search ..... 405/15, 16, 19, 405/29, 68, 107, 110, 111, 115; 383/42, 68, 69, 93, 95–97

(56) References Cited

U.S. PATENT DOCUMENTS 3,886,751 * 6/1975 Porraz Jimenez Labora et al. ... 405/107
4,362,433 * 12/1982 Wagner et al. ..... 405/107
4,650,368 * 3/1987 Bayer ..... 405/111
5,007,250 * 4/1991 Musielak ..... 383/66 X
5,040,919 * 8/1991 Hendrix ..... 405/115
5,059,065 * 10/1991 Doolaege ..... 405/115
5,785,455 * 7/1998 Eaker ..... 405/68 X
5,857,806 * 1/1999 Melin ..... 405/115
5,984,577 * 11/1999 Strong ..... 405/115 X
5,988,946 * 11/1999 Reed ..... 405/115
6,056,438 * 5/2000 Bradley ..... 405/19 X
6,126,362 * 10/2000 Carter et al. ..... 405/16 X

* cited by examiner

*Primary Examiner*—David Bagnell
*Assistant Examiner*—Tara L. Mayo
(74) *Attorney, Agent, or Firm*—Boniard I. Brown

(57) ABSTRACT

Elongated flood control bags are filled with pillows filled with liquid or inflated with air, the pillows being arrayed in each bag, typically end to end and stacked. The bags are deployed at ground level for control of liquid flow to protect property and terrain against flow of water and rain.

15 Claims, 2 Drawing Sheets

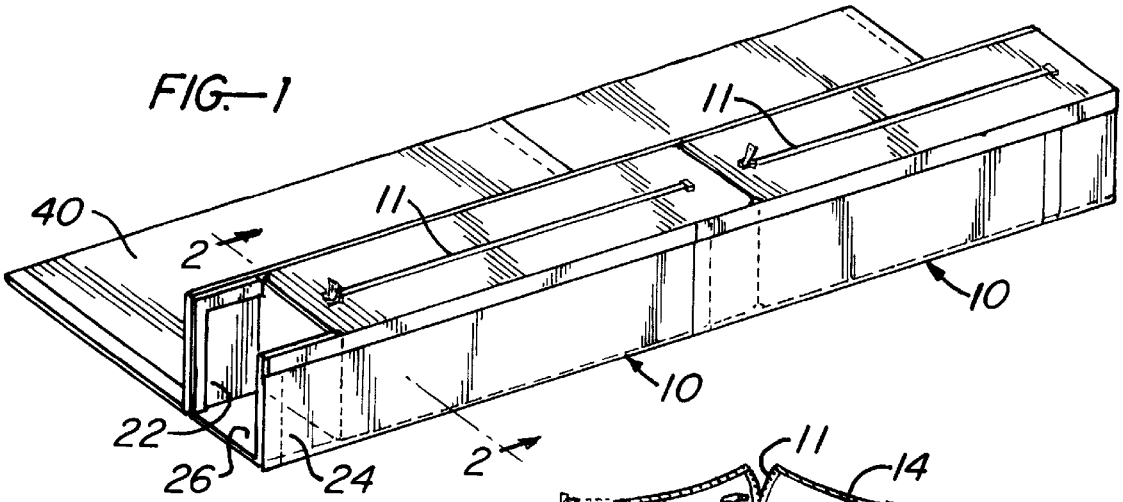
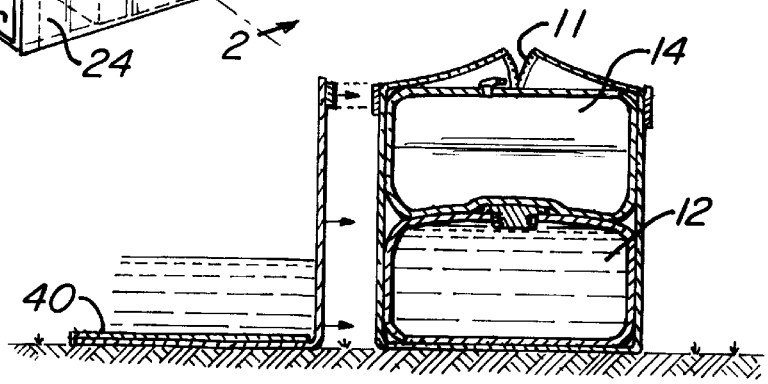
FIG.—2
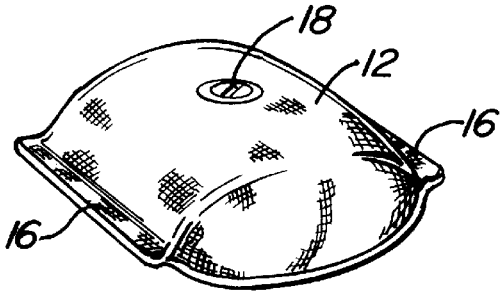
FIG.—3
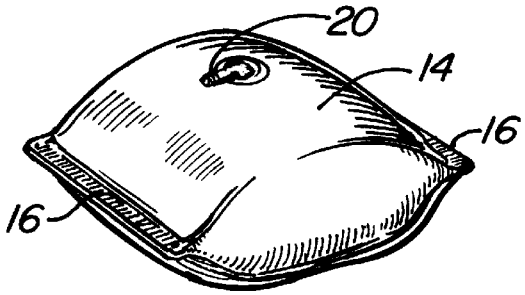
FIG.—4

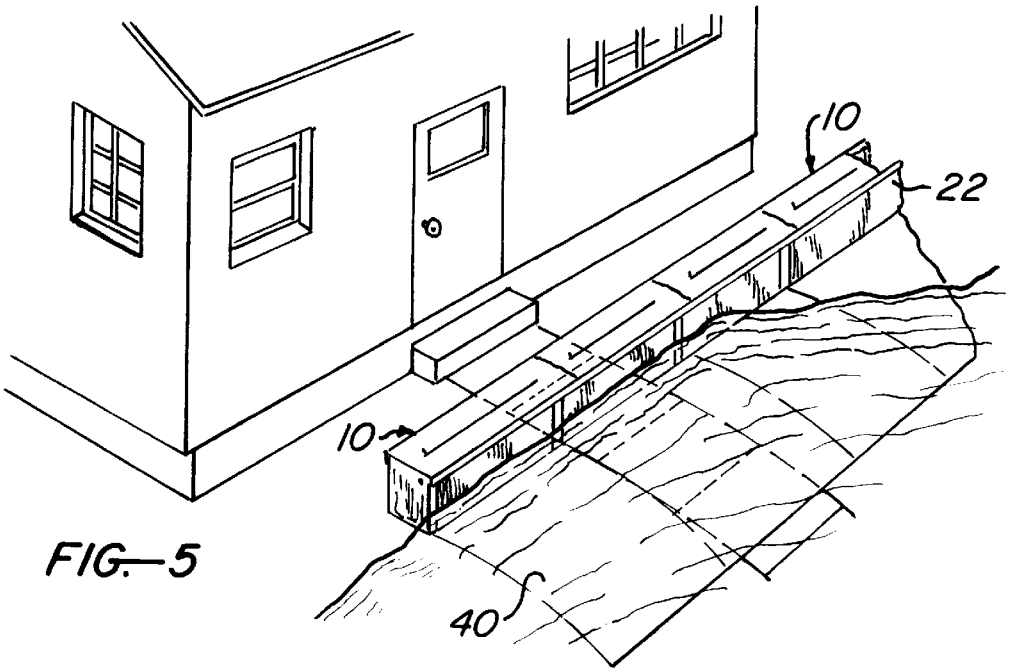
FIG.—5
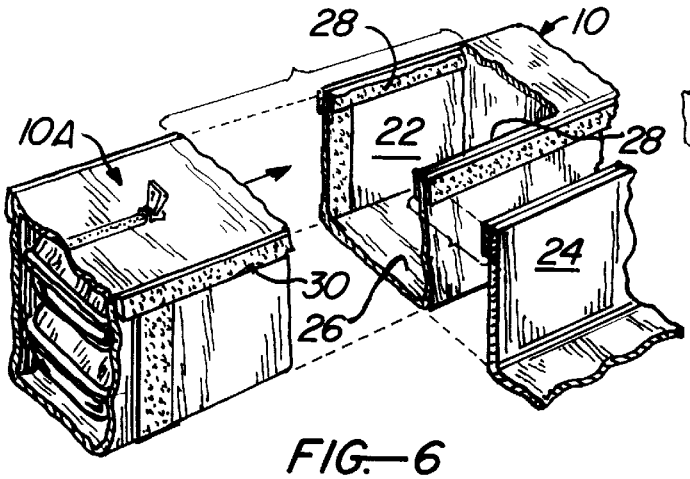
FIG.—6
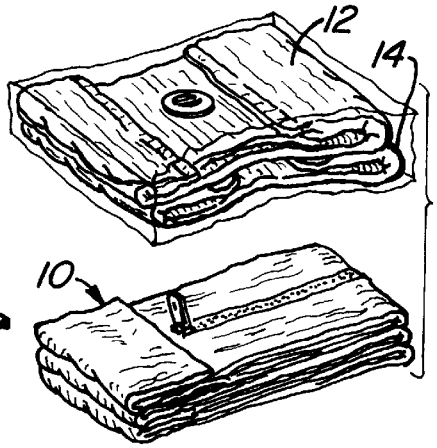
FIG.—8
FIG.—7
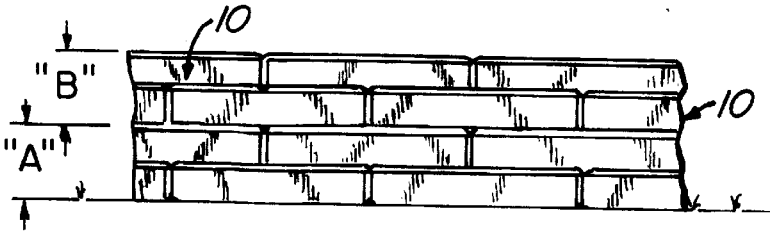

FLUID CONTROL BAG ASSEMBLIES AND METHOD OF USING THE SAME

BACKGROUND AND SUMMARY OF THE INVENTION

The present invention provides elongated bags with fluid-filled pillows therein, disposed in end-to-end array to provide a barrier to control liquid flow over a ground surface.

In the prior art, solutions and structures to address flood control have generally involved bags or containers of soil, dirt-filled bags, arrayed and stacked. Such prior art arrangements involved substantial expense and labor in obtaining dirt, shoveling, filling bags, positioning filled bags atop each other, and later removing the dirt from bags and disposing of it by transporting, dumping, etc.

The present invention greatly reduces the time, labor and expense of preparing, disposing of flood control bags and the removal and disposition of bag contents after use in flood control. In accordance with the invention, a liquid control barrier comprises typically a plurality of elongated bags, the bags being filled with fluid-filled pillows, some water-filled and some air-filled, arrayed in each bag. The bags are filled with air by readily available conventional equipment, and are similarly filled with water by readily available hoses. The bags are preferably attached to each other, end-to-end, and are arrayed to present a flood-control barrier.

The fluid-filled pillows are arrayed within a bag with water-filled pillows preferably in the lower portion of the bag. the bags are arrayed end-to-end, preferably with flaps on one bag engaging fastening components on an adjacent bag.

After use in flood control, the pillows are readily emptied by opening valves on the air-filled pillows and by draining the water-filled bags by opening a closure member. The bags and the pillows are readily foldable for compact storage and transport.

BRIEF DESCRIPTION OF THE DRAWINGS

FIG. 1 is a perspective view of a plurality of bags according to the invention connected to control liquid flow;

FIG. 2 is a sectional view taken at line 2—2 in FIG. 1;

FIGS. 3 and 4 are perspective views of preferred forms of fluid-containing pillows for disposing in the bags of FIG. 1;

FIG. 5 is a perspective view of a plurality of the bags of FIG. 1 connected end-to-end for controlling liquid flow;

FIG. 6 is a perspective view showing end-to-end connection of bags of the invention by flaps extending from one bag into engagement with fastener means on the other bag;

FIG. 7 shows an array of fluid-filled pillows in an elongated bag; and

FIG. 8 shows an empty bag or bags of FIGS. 3 and 4 folded for storage and shipment.

DESCRIPTION OF THE PREFERRED EMBODIMENTS

Referring to the drawings, FIGS. 1 and 2 illustrate a preferred embodiment of the invention, wherein a plurality of elongated bags each contain a plurality of pillows or balloons filled with water, air or gas.

A plurality of the bags connected together at their ends serve to prevent water, debris and dirt, as when flowing down a slope or otherwise, from flowing onto structures and other property as when a river or stream overflows, when heavy rainfall occurs, etc., thus to prevent damage to such structures and property by diverting or blocking flow of water and debris.

The bags 10 are preferably and typically fabricated of woven fabric or of sheet plastic, but for use in diverting or blocking chemical spills, they may be fabricated of such material as will resist chemical action or attack on the bag material.

Each bag 10 preferably is closable by an appropriate fastener arrangement, such as a non-leak zipper 11 extending along its length, preferably being of the type utilized with wetsuits, or by snap fasteners, VELCRO® hook-and-loop fastener strips, etc.

Preferred forms of pillows 12, 14 are shown in FIGS. 3 and 4, each bag being formed of appropriate plastic and comprising a pillow-shaped container having seams 16 along its opposite edges, as shown. FIG. 3 shows a bag for water or liquid containment having a threaded opening member and a threaded closure member 18 mounted thereon for introducing and removing liquid, such as water. Bag 14 has a pneumatic valve 20 mounted thereon for introduction and removal of pressurized air or gas.

The pillows are adapted for the disposition of a plurality thereof in a bag 10 in end-to-end array, and in stacked array (FIG. 7). The pillows, at least some thereof, are preferably covered with a burlap fabric or other appropriate sheet material to facilitate their being stacked atop one another without or with only minimal relative sliding movement.

As with the bag 10, the pillows, when empty, are readily foldable and storable, as indicated in FIG. 8, and are thus readily portable and storable in quantity, when empty.

An array of pillow-filled bags, arranged and stacked to form a barrier or wall, is shown in FIG. 7.

FIG. 6 illustrates container bags secured or attached together end-to-end by flaps including side flaps 22, 22 and bottom flaps 26, which extend outwardly from the end portion of bag 10. The adjacent bag is positioned in the space defined by the side and bottom walls extending from bag 10, and is attached by VELCRO® hook-and-loop fasteners 28, or other appropriate means, at the edge portions of the side walls of the adjacent bag. A plurality of bags connected in such manner provides an elongated row or wall of stacked bags. A multiplicity of connected bags may be arrayed in a straight line, a curved line, or a sharply bent line.

The arrangement of pillows in a bag 10 preferably includes the positioning of water or liquid-filled pillows in the lower portion of the bag, preferably in a criss-cross array for stability and the disposition of air or gas-filled pillows atop water-filled pillows, particularly where a relatively high barrier is needed against water flow.

Pillow-filled bags, particularly water-filled bags, exert substantial pressure against the surface of the supporting ground, thus filling uneven ground surfaces and imperfections, and aiding in preventing water from passing between filled bags and the ground surface.

In preparation for installation, the pillows are filled with air, either by mouth blowing or by manual or power pump, and liquid pillows are filled with water or other liquid by introducing the same via the threaded opening at 18 (FIG. 3). A filled bag 10 is closed by zipper 11 which extends along its upper surface.

An elongated apron 40 (FIG. 5) may be attached to and detached from a string of bags 10, and disposed to prevent liquid flow on an adjacent slope, as across a structure, doorway, etc., whereby water may run or flow down-slope without soaking the soil in the region of a structure, etc., being protected, or to prevent entry of water into a structure, such as that shown in FIG. 5.

After the utilization of the pillow-filled bags, the pillows are removed from the bags, and the water and the air pressure are removed therefrom via threaded closures 18 and air valves 20 on the pillows.

The pillows are readily foldable and compacted for storage and transport. This involves much less effort and time than the removal of sand or dirt from sand bags, then cleaning, folding and storing such bags, as well as disposing of the dirt, etc., from the bags.

Thus there has been shown and described flood control bags and assemblies which fulfill all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A liquid flow control barrier, comprising:

at least one elongated bag, a plurality of at least three liquid-filled pillows, said at least three pillows extending lengthwise of the at least one bag in end-to-end relation, and said at least one elongated bag being supportable on a surface to divert fluid flow thereon.

2. A barrier according to claim 1, wherein:

the flow control barrier comprises a plurality of said elongated bags, each having a plurality of at least four said liquid-filled pillows therein in end-to-end array, and wherein said elongated bags are attached together in end-to-end relation.

3. A barrier according to claim 2, and further comprising:

at least one side flap extending from side edges of at least certain ones of said pillows, and said at least one side flap having a fastener strip on an edge portion thereof for attachment to side walls of an adjacent pillow to retain the pillows together.

4. A barrier according to claim 1, wherein at least one of said bags is closable along its length.

5. A barrier according to claim 1, and further comprising:

a second row of at least three additional pillows disposed end-to-end atop said plurality of at least three liquid-filled pillows.

6. A barrier according to claim 5, and further including a plurality of air-filled pillows disposed atop said plurality of at least three liquid-filled pillows.

7. A barrier according to claim 1, and further including:

at least one flap attached to and extending from end portions of each of certain of said bags, and fastener strips disposed on edges of said at least one flap for attachment to fastener strips on adjacent bags.

8. A barrier according to claim 1, and further including:

an apron extending laterally from at least one bag on a ground surface to extend generally down slope to prevent flood water seepage into soil.

9. A barrier according to claim 1, and further comprising:

a flap attached to a lower portion of at least certain ones of said pillows to extend under respective pillows adjacent to said certain ones of said pillows to retain the adjacent pillows in position by the weight of their being disposed on the flap.

10. A barrier according to claim 9, and further comprising:

at least one side flap extending from said edges of at least certain ones of said pillows, and said at least one side flap having a fastener strip on an edge portion thereof for attachment to side walls of an adjacent pillow to retain the pillows together.

11. A method of flood and spill control and diversion, comprising the steps of:

providing at least one elongated bag, providing a plurality of at least four fluid-filled pillows in said at least one elongated bag, and disposing the at least one elongated bag to control the flood or spill.

12. A method according to claim 11, wherein the step of providing comprises the steps of filling certain of said plurality of said pillows with air, and filling additional ones of said plurality of said pillows with water.

13. A method according to claim 11, wherein the step of disposing comprises the step of:

positioning a plurality of said bags in an end-to-end array to control liquid flow.

14. A method according to claim 13, wherein the step of positioning further includes;

arranging said elongated bags generally transversely of the direction of the liquid flow or spill to be diverted.

15. A method according to claim 13, wherein the step of positioning further includes the step of arraying said bags to prevent entry of flow into a door of a structure.

* * * * *